US009783916B2

(12) United States Patent
Tone et al.

(10) Patent No.: US 9,783,916 B2
(45) Date of Patent: Oct. 10, 2017

(54) WOVEN FABRIC

(75) Inventors: Hajime Tone, Osaka (JP); Hideki Kawabata, Osaka (JP)

(73) Assignee: TOYOBO SPECIALTIES TRADING CO., LTD., Osaka (JP)

( * ) Notice: Subject to any disclaimer, the term of this patent is extended or adjusted under 35 U.S.C. 154(b) by 453 days.

(21) Appl. No.: 13/202,661

(22) PCT Filed: Jun. 23, 2009

(86) PCT No.: PCT/JP2009/061415
§ 371 (c)(1),
(2), (4) Date: Aug. 22, 2011

(87) PCT Pub. No.: WO2010/097970
PCT Pub. Date: Sep. 2, 2010

(65) Prior Publication Data
US 2011/0302689 A1 Dec. 15, 2011

(30) Foreign Application Priority Data
Feb. 26, 2009 (JP) ..... 2009-044688

(51) Int. Cl.
*D03D 15/00* (2006.01)
*D03D 13/00* (2006.01)

(52) U.S. Cl.
CPC ..... *D03D 15/00* (2013.01); *D03D 13/008* (2013.01); *D03D 15/0083* (2013.01);
(Continued)

(58) Field of Classification Search
CPC ..... D10B 2331/02; D10B 2331/04; D10B 2401/063; D10B 2401/14; D10B 2501/00;
(Continued)

(56) References Cited

U.S. PATENT DOCUMENTS 5,361,808 A * 11/1994 Bowen, Jr. ..... D03D 15/00 139/383 A
5,449,548 A * 9/1995 Bowen, Jr. ..... D03D 15/00 139/383 A
5,462,790 A * 10/1995 Matsuki et al. ..... 442/195

FOREIGN PATENT DOCUMENTS

JP 2004-316015 A 11/2004
JP 2005-133253 A 5/2005
(Continued)

OTHER PUBLICATIONS

Japanese Patent Office, International Search Report in International Patent Application No. PCT/JP2009/061415 (dated Sep. 8, 2009).
(Continued)

*Primary Examiner* — Elizabeth M Cole
(74) *Attorney, Agent, or Firm* — Wenderoth, Lind & Ponack, L.L.P.

(57) ABSTRACT

Provided is a woven fabric which is suitable for use as a covering fabric for down garments, down jackets, bedclothes, sleeping bags, etc. The woven fabric is lightweight and thin, has a high tear strength, and can retain low air permeability even after laundering. The woven fabric is constituted of synthetic multifilament yarns. The woven fabric is characterized in that at least one side thereof has been calendered and the monofilaments in at least part of the synthetic multifilament yarns have been thereby compressed in a stacked state. The woven fabric is further characterized in that the monofilaments are fibers having an unusual cross-section, the degree of unusualness of the cross section as determined before calendering being 2.0-6.0, that the synthetic multifilament yarns have a fineness of 7-44 dtex, and that the woven fabric has a cover factor of 1,300-2,200.

4 Claims, 2 Drawing Sheets

(52) U.S. Cl.
CPC ..... *D10B 2331/02* (2013.01); *D10B 2331/04* (2013.01); *D10B 2401/063* (2013.01); *D10B 2401/14* (2013.01); *D10B 2501/00* (2013.01); *D10B 2503/06* (2013.01); *Y10T 442/3122* (2015.04)

(58) Field of Classification Search
CPC .. D10B 2503/06; D03D 15/00; D03D 13/008; D03D 15/0083; Y10T 442/3122
USPC ..... 442/195, 196
See application file for complete search history.

(56) References Cited

FOREIGN PATENT DOCUMENTS

| | | | | |
|---|---|---|---|---|
| JP | 2005-139575 | A | | 6/2005 |
| JP | 2005139575 | A | * | 6/2005 |
| JP | 2009-013511 | A | | 1/2009 |

OTHER PUBLICATIONS

Chinese Patent Office, First Office Action in Chinese Patent Application No. 200980156556.7 (dated Oct. 8, 2012).
Japanese Patent Office, Explanation for an Accelerated Examination in Japanese Patent Application No. 2009-044688 (dated Jun. 2, 2012).

* cited by examiner

WOVEN FABRIC

TECHNICAL FIELD

The present invention relates to a woven fabric that is lightweight and thin, has a high tear strength, and can retain low air permeability even after washing. More specifically, the present invention relates to a woven fabric that suppresses leakage of cotton or down, particularly to a woven fabric suitable for use as a covering fabric for, for example, down wear, down jackets, futons (Japanese bedding), and sleeping bags.

BACKGROUND ART

A fabric for use as a covering fabric for down wear or futons is required to have low air permeability to suppress leakage of cotton or down, and, in addition, is also required to be lightweight and thin.

Such a fabric is conventionally made from natural fibers, such as silk or cotton, excellent in feeling and comfort. However, the fabric made of the natural fiber is low in tear strength and poor in durability; when the fabric is used particularly for down jacket, there is caused a problem that cotton or down spouts out easily from an elbow or sleeve portion thereof.

A polyester multifilament, a nylon multifilament and a conjugated synthetic fiber fabric thereof have also been used as the above-mentioned fabric. These fabrics are frequently used particularly for coats, blousons, golf wears, outdoor wears for sports, and so forth since they are soft, light, windproof, highly water-repellent, and highly fastness.

However, in order to allow the woven fabrics to have down-proofness to suppress leakage of down, the woven fabrics need to have a dense structure, which causes a problem that the woven fabrics become hard.

Further, in order to respond to the need for reducing the weight and thickness of a woven fabric without lowering tear strength, a woven fabric that can achieve a reduction in weight without lowering tear strength has been proposed. Such a woven fabric is made from yarns having a small fineness, and also uses high-strength yarns that are different from base yarns and have a specific fineness. For example, Patent Document 1 discloses a lightweight woven fabric that is constituted from base yarns having a fineness of 10 dtex to 30 dtex and reinforcing yarns having a fineness of 20 dtex to 60 dtex and has a cover factor of 1300 to 1700 and a tear strength of 8 N or more. However, the woven fabric disclosed in Patent Document 1 is made from polyamide fibers whose shrinkage ratio is higher than that of a polyester, and therefore has a problem that the weave structure thereof tends to deform during washing. This makes it impossible for the woven fabric to retain low air permeability after washing.

Patent Document 2 discloses a woven fabric for use as a covering fabric for futons. The woven fabric is constituted from synthetic multifilaments, each of which is made from modified cross-section single yarns having a degree of modification of 2 to 7 and has a fineness of 15 dtex to 35 dtex, and has a cover factor of 1500 to 2000, a tear strength of 6 to 15 N, and an air permeability before washing of 0.3 to 1.5 cc/cm$^2$/s. However, in Patent Document 2, there is no description about the durability of the woven fabric against, for example, washing based on air permeability. Further, conventional products have a problem in that the air permeability thereof is reduced due to repeated wear, compression for storage, and washing during long-time use and therefore leakage of down is likely to occur.

PRIOR ART DOCUMENTS

Patent Documents

Patent Document 1: JP-A-2004-316015
Patent Document 2: JP-A-2005-139575

SUMMARY OF THE INVENTION

Problems to be Solved by the Invention

In view of the above problems associated with the conventional art, it is an object of the present invention to provide a woven fabric that is lightweight and thin, has a high tear strength, and can retain low air permeability even after washing, more specifically a woven fabric suitable for use as a covering fabric for, for example, down wear, down jackets, futons, and sleeping bags.

Solutions to the Problems

In order to solve the above problems, the present inventors have extensively studied, and as a result, the present invention has been completed. A woven fabric of the present invention is a woven fabric characterized by comprising synthetic multifilaments, the woven fabric having at least one surface calendered so that, in at least part of the synthetic multifilaments, monofilaments are compressed in a state where they overlap one another, wherein the monofilaments are modified cross-section yarns having a degree of modification before calendering of 2.0 to 6.0, the synthetic multifilaments have a fineness of 7 dtex to 44 dtex, and the woven fabric has a cover factor of 1300 to 2200. In the present invention, by using the synthetic multifilament constituted from monofilaments which are modified cross-section yarns having a degree of modification of 2.0 to 6.0 and by calendering on at least one surface of the woven fabric, the projections and the recesses of the adjacent monofilaments are overlapped one another in at least part of the multifilaments. By utilization of this overlap successfully, movement of each monofilament can be controlled. As a result, the sift of monofilaments is suppressed during washing, increasing of an air permeability which is caused by repeating washing can be suppressed.

The fineness of the monofilaments is preferably 0.4 dtex to 2.0 dtex. The monofilaments are preferable to have a cross section including a recess, more preferable to have a Y-shaped cross section or a cross-shaped cross section. Each projection of the Y-shaped cross section or the cross-shaped cross section has preferably a structure in which a width of its tip is the same as or larger than that of its base. The material used for forming the monofilament is preferably polyamides or polyesters.

The tear strength of the woven fabric in both warp and weft directions as measured by a pendulum method is preferably 8 N to 50 N. An air permeability after 10-times washing of the woven fabric is preferably 2.00 cc/cm$^2$/s or less. A retention ratio of water-pressure resistance after 20-times washing of the woven fabric with respect to initial water-pressure resistance is preferably 70% or higher.

The woven fabric according to the present invention is suitable for use as a covering fabric for, for example, down wear, down jackets, futons, and sleeping bags.

Effects of the Invention

The woven fabric according to the present invention is lightweight and thin, has a high tear strength, and can retain low air permeability even after washing, and is therefore suitable for use as a covering fabric for, for example, down wear, down jackets, futons, and sleeping bags.

MODE FOR CARRYING OUT THE INVENTION

Figure 1:
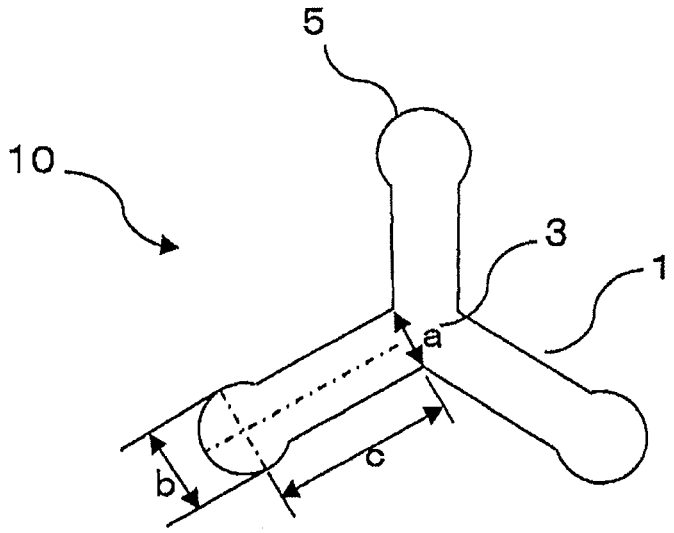
FIG. 1 is a schematic diagram illustrating a Y-shaped discharge opening of a spinneret used in the present invention.

A woven fabric of the present invention is a woven fabric characterized by comprising synthetic multifilaments, the woven fabric having at least one surface calendered so that, in at least part of the synthetic multifilaments, monofilaments are compressed in a state where they overlap one another, wherein the monofilaments are modified cross-section yarns having a degree of modification before calendering of 2.0 to 6.0, the synthetic multifilaments have a fineness of 7 dtex to 44 dtex, and the woven fabric has a cover factor of 1300 to 2200.

First, a monofilament used in the present invention will be specifically described.

A monofilament used in the present invention is a modified cross-section yarn, and the degree of modification thereof before calendering is preferably 2.0 or more, more preferably 2.5 or more, but is preferably 6.0 or less, more preferably 5.0 or less. By setting the degree of modification of the monofilament used in the present invention to a value within the above range, it is possible to form a multifilament in which projections of the monofilaments are got into recesses of the monofilaments adjacent thereto so that the monofilaments overlap one another with few gaps. Therefore, a resulting woven fabric can have low air permeability. Further, by setting the degree of modification of the monofilament used in the present invention to a value within the above range, it is also possible to tightly bind the monofilaments together. Therefore, a resulting woven fabric can retain low air permeability because movement of its weave structure is suppressed even during washing. On the other hand, if the degree of modification of a monofilament is less than 2.0, the monofilaments cannot overlap one another with few gaps. This makes it difficult for a resulting woven fabric to retain low air permeability after washing. If the degree of modification of a monofilament exceeds 6.0, there is a problem that a resulting woven fabric undesirably has a low tear strength. The "degree of modification" used herein is a value calculated by dividing the length of the major axis (the longest diameter) by the length of the minor axis (the shortest diameter) of the cross section of the monofilament.

The cross-sectional shape of the monofilament is not particularly limited as long as the monofilament has a degree of modification within the above range. However, the monofilament preferably has a cross section including a recess, and examples of such a cross section include a Y-shaped cross section, a cross-shaped cross section, a W-shaped cross section, a V-shaped cross section, and a ∞-shaped (infinity) cross section. Among them, a Y-shaped cross section and a cross-shaped cross section are more preferred because their projections and recesses are clear. Particularly, a Y-shaped cross section is preferred because optimum overlap between a projection and a recess can be achieved. When the monofilament used in the present invention has a Y-shaped cross section, the monofilaments are compressed and fixed by calendering (which will be described below) in a state where their projections and recesses optimally overlap each other, and are therefore most tightly bound together. This makes it possible for a resulting woven fabric to retain excellent low air permeability even after washing. Further, when the monofilament used in the present invention has a Y-shaped cross section, a resulting woven fabric has excellent water absorbing property and diffusivity and therefore gives little wet feeling to the skin. Therefore, a covering fabric using such a woven fabric is particularly preferred because of its comfortable dry feeling.

Further, each of the projections of the Y-shaped cross section or the cross-shaped cross section preferably has a structure in which the width of its tip is the same as or larger than that of its base. This is because when each of the projections has a structure in which the width of its tip is the same as or larger than that of its base, the projections and the recesses are more firmly caught on each other by calendering (which will be described below) than when each of the projections has a tapered structure. As a result, it is possible for a resulting woven fabric to suppress impairment of low air permeability even after washing. Further, each of the projections of the Y-shaped cross section or the cross-shaped cross section comprises (i) a segment having a width which is larger than that of its base and (ii) a remaining segment, and the segment of each projection having a width which is larger than that of the base is preferably shorter than the remaining segment.

In order to obtain a monofilament having such a projection in which the width of its tip is the same as or larger than that of its base, the present inventors have extensively studied to devise the shape of a discharge opening of a spinneret. As a result, the present inventors have solved the problem that the tip of a cross-sectional projection of a monofilament is thinned during cooling in a quenching unit and drawing, that is, the problem that a cross-sectional projection is tapered by allowing the tip of a slit of a discharge opening of a spinneret for spinning a polymer to have a width larger than that of the base of the slit. For example, as shown in FIG. 1, by setting a width "b" of a tip 5 of a slit 1 of a spinneret discharge opening 10 to a value larger than a width "a" of a base 3 and by appropriately adjusting a length "c" of the slit 1, it is possible to obtain a monofilament which has projections each having a base and a tip whose width is the same as or larger than that of the base and which has a degree of modification within the above range.

The fineness of the monofilament is not particularly limited, but is preferably 0.4 dtex or more, more preferably 0.6 dtex or more, but is preferably 2.0 dtex or less, more preferably 1.5 dtex or less. By setting the fineness of the monofilament to a value within the above range, it is possible to obtain a woven fabric having an appropriate tear strength and low air permeability. On the other hand, if the fineness of the monofilament is less than 0.4 dtex, the monofilament is too thin to obtain a woven fabric having a necessary tear strength. If the fineness of the monofilament exceeds 2.0 dtex, it is difficult to obtain a woven fabric having low air permeability.

Examples of a raw material used for forming the monofilament include, but are not limited to, synthetic polymers such as polyesters (e.g., polyethylene terephthalate, polypropylene terephthalate, polybutylene terephthalate), polyamides (e.g., nylon 6, nylon 66, nylon 46, nylon 12, nylon 610, nylon 612, and copolymers thereof), polyacrylonitrile, polyvinyl chloride, and polyvinyl alcohol. Among them, polyamides are particularly preferred because even when a polyamide is spun into a monofilament having a modified cross section, a resulting woven fabric has soft and good feeling.

When a polyester is used as a raw material for forming the monofilament, the limiting viscosity thereof is preferably 0.58 or more, more preferably 0.60 or more, but is preferably 1.00 or less, more preferably 0.90 or less. By setting the limiting viscosity of the raw material to a value within the above range, it is possible to obtain a monofilament having an appropriate breaking strength without incurring high cost. When the raw material having a limiting viscosity of 0.60 or more is used to form a monofilament having a Y-shaped cross section, a resulting monofilament can have clear projections and recesses. On the other hand, if the limiting viscosity of the raw material is less than 0.58, the following problems occur: reduction in the tear strength and breaking strength of a product for lack of breaking strength, which results also from that the breaking strength of a modified cross-section yarn is lower than that of a circular cross-section yarn, and deterioration in processing runnability and product durability for lack of breaking elongation. On the other hand, if the limiting viscosity of the raw material exceeds 1.00, costs are very high, which is not practical. It is to be noted that when the raw material having a limiting viscosity of less than 0.60 is used to form a monofilament having a Y-shaped cross section, a resulting monofilament undesirably has a triangle-like cross section having no clear projections and no clear recesses.

When, for example, nylon is used as a raw material for forming the monofilament, the relative viscosity thereof is preferably 2.5 or more, more preferably 3.0 or more. By setting the relative viscosity of the raw material to 2.5 or more, it is possible to obtain a monofilament having an appropriate breaking strength. When the raw material having a relative viscosity of 3.0 or more is used to form a monofilament having a Y-shaped cross section, a resulting monofilament can have clear projections and recesses. On the other hand, if the relative viscosity of the raw material is less than 2.5, the following problems are likely to occur: reduction in the tear strength and breaking strength of a product for lack of breaking strength, which results also from that the breaking strength of a modified cross-section yarn is lower than that of a circular cross-section yarn, and deterioration in processing runnability and product durability for lack of breaking elongation. When the raw material having a relative viscosity of less than 3.0 is used to form a monofilament having a Y-shaped cross section, a resulting monofilament undesirably has a triangle-like cross section having no clear projections and no clear recesses.

If necessary, a hygroscopic material, an antioxidant, a matting agent, an ultraviolet absorber, an anti-bacterial agent, etc., may be added singly or in combination of two or more of them to the monofilament.

Hereinbelow, a synthetic multifilament used in the present invention will be specifically described.

A synthetic multifilament used in the present invention is made from the monofilaments described above.

The fineness of the synthetic multifilament is not particularly limited, but is preferably 7 dtex or more, more preferably 10 dtex or more, but is preferably 44 dtex or less, more preferably 33 dtex or less. By setting the fineness of the synthetic multifilament to a value within the above range, it is possible to obtain a woven fabric that is lightweight and thin and has a necessary strength. On the other hand, if the fineness of the synthetic multifilament is less than 7 dtex, it is impossible to obtain a woven fabric having a necessary strength, and if the fineness of the synthetic multifilament exceeds 44 dtex, a resulting woven fabric is bulky and is therefore not lightweight and thin.

The breaking strength of the synthetic multifilament is not particularly limited, but is preferably 4.0 cN/dt or more, more preferably 4.2 cN/dt or more. By setting the strength of the synthetic multifilament to 4.0 cN/dt or more, it is possible to obtain a woven fabric having an appropriate tear strength even when the degree of modification is high.

The breaking elongation of the synthetic multifilament is not particularly limited, but is preferably 35% or more, more preferably 38% or more, but is preferably 50% or less, more preferably 48% or less. It can be considered that by setting the breaking elongation of the synthetic multifilament to a value within the above range, it is possible to improve the tear strength of a resulting woven fabric. This is because when the resulting woven fabric is torn, stress produced by tearing the woven fabric is shared among many yarns due to proper elongation of the yarns so that stress applied to each of the yarns is decreased. On the other hand, if the breaking elongation of the synthetic multifilament is less than 35%, the tear strength of a resulting woven fabric is lowered. This is because stress produced by tearing the resulting woven fabric tends to be concentrated on a single yarn that is about to be torn. If the breaking elongation of the synthetic multifilament exceeds 50%, the yarns cannot follow tension change or frictional resistance between the yarns and various yarn-contacting members, which is associated with an increase in the speed of weaving, an increase in the density of weaving, and a reduction in friction during weaving, and therefore there is a fear that the occurrence frequency of yarn breakage increases. In addition, there is also a fear that the breaking strength of the synthetic multifilament is lowered even when various spinning-drawing conditions are adjusted and therefore a resulting woven fabric undesirably has a low tear strength.

A method for producing the synthetic multifilament is not particularly limited, but, for example, a polyamide-based multifilament or a polyester-based multifilament can be produced using a spin-draw type spinning-drawing continuous machine or can be produced through two steps using a spinning machine and a drawing machine. In the case of the spin-draw type, the speed of a spun yarn take-up godet roller is preferably set to 1500 m/min to 4000 m/min, more preferably 2000 m/min to 3000 m/min.

The boiled water shrinkage ratio, thermal stress, birefringence, and unevenness of thickness of the synthetic multifilament are not particularly limited. The synthetic multifilament may be subjected to crimping processing such as false twisting, or may be a conjugated yarn.

Hereinbelow, a woven fabric according to the present invention will be specifically described.

A woven fabric according to the present invention is constituted from the synthetic multifilaments described above, and at least one surface of the woven fabric is subjected to calendering.

The weave structure of the woven fabric is not particularly limited, and any weave structure such as a plain weave, a twill weave, or a satin weave may be used. However, a plain weave is preferably used to reduce air permeability. Further, in order to increase the tear strength of the woven fabric, a rip-stop taffeta weave is particularly preferably used.

Further, a weaving machine for use in producing the woven fabric is not particularly limited, either, and a water jet loom, an air jet loom, or a rapier loom can be used.

The woven fabric after weaving is scoured, relaxed, preset, dyed, and subjected to finish processing by using processing machines usually used for processing a thin woven fabric. At this time, at least one surface of the woven fabric is preferably subjected to calendering. By subjecting the woven fabric to calendering, the monofilaments are compressed and fixed in a state where they overlap one another in at least part of the multifilaments. This makes it possible for the woven fabric to retain low air permeability even after washing.

The calendering may be performed on only one surface or both surfaces of the woven fabric. However, when the calendering is performed on both surfaces of the woven fabric, there is a case where the convex surfaces of surface fibers on the upper side of the woven fabric also become flat so that the woven fabric has undesirable gloss and hard feeling and further a resulting fabric is poor in detachability from the skin and therefore sticks to the skin when getting wet, which gives an uncomfortable feeling. Therefore, when such a feeling is not desired, calendering is preferably performed on only one surface of the woven fabric. Further, the number of times calendering is performed is not particularly limited, and calendering may be performed only once or two or more times as long as projections and recesses of the monofilaments can be sufficiently compressed.

The temperature of calendering is not particularly limited, but is preferably higher by 80° C. or more, more preferably by 120° C. or more than the glass transition temperature of a raw material used, but is preferably lower by 20° C. or more, more preferably by 30° C. or more than the melting point of the raw material used. By setting the temperature of calendering to a value within the above range, it is possible to obtain a woven fabric that can retain both low air permeability and high tear strength. On the other hand, if the temperature of calendering is lower than the glass transition temperature of a raw material used +80° C., it is difficult to obtain a woven fabric having low air permeability due to a low degree of compression of the monofilaments. If the temperature of calendering is higher than the melting point of a raw material used −20° C., the degree of compression of the monofilaments is high, but there is a case where a resulting woven fabric has a significantly low tear strength. For example, when a polyamide is used as a raw material, the temperature of calendering is preferably 120 to 200° C., more preferably 130 to 190° C. When a polyester is used as a raw material, the temperature of calendering is preferably 160 to 240° C.

The pressure of calendering is preferably 0.98 MPa (10 kgf/cm$^2$) or higher, more preferably 1.96 MPa (20 kgf/cm$^2$) or higher, but is preferably 5.88 MPa (60 kgf/cm$^2$) or less, more preferably 4.90 MPa (50 kgf/cm$^2$) or less. By setting the pressure of calendering to a value within the above range, it is possible to obtain a woven fabric that can retain both low air permeability and tear strength. On the other hand, the pressure of calendering is less than 0.98 MPa (10 kgf/cm$^2$), there is a case where a woven fabric having low air permeability cannot be obtained due to a low degree of compression of the monofilaments. When the pressure of calendering is higher than 5.88 MPa (60 kgf/cm$^2$), there is a fear that the monofilaments are excessively compressed so that a resulting woven fabric has a significantly low tear strength.

The material of a calender is not particularly limited, but one of two rolls is preferably made of a metal. The use of a metallic roll makes it possible to adjust the temperature of the roll itself and to uniformly compress a fabric surface. The material of the other roll is not particularly limited, but is preferably made of a metal or resin. When the other roll is made of a resin, the resin is preferably nylon.

If necessary, the woven fabric may also be subjected to various functional finish, such as water-repellent treatment, coating, and laminating, or softening or resin finish for adjusting the feeling or strength of the woven fabric. Examples of a softener to be used include amino-modified silicones, polyethylene-based softeners, polyester-based softeners, and paraffin-based softeners. Post finish such as softening or silicone finish may be performed to the woven fabric. Examples of a resin for use in resin finish include various resins such as melamine resins, glyoxal resins, urethane-based resins, acrylic resins, and polyester-based resins.

The cover factor (CF) of a resulting woven fabric is set to 1300 to 2200. The cover factor (CF) is preferably 1600 or more, and 2000 or less. By setting the cover factor of a resulting woven fabric to a value within the above range, it is possible to obtain a woven fabric that is lightweight and thin and has low air permeability. If the cover factor of the woven fabric is less than 1300, the woven fabric is lightweight and thin, but is less likely to satisfy low air permeability. On the other hand, if the cover factor of the woven fabric exceeds 2200, the woven fabric satisfies low air permeability, but undesirably tends to be heavy. Here, the cover factor (CF) of the woven fabric is calculated by the following formula:

$$CF=T\times(DT)^{1/2}+W\times(DW)^{1/2},$$

wherein T represents the warp density of the woven fabric (the number of yarns/2.54 cm), W represents the weft density of the woven fabric (the number of yarns/2.54 cm), DT represents the fineness (dtex) of the warp constituting the woven fabric, and DW represents the fineness (dtex) of the weft constituting the woven fabric.

The tear strength of the woven fabric according to the pendulum method is not particularly limited, but the tear strength in both the warp and weft directions is preferably 8 N or more, more preferably 10 N or more, even more preferably 12 N or more, but is preferably 50 N or less, more preferably 40 N or less, even more preferably 30 N or less. By setting the tear strength of the woven fabric to a value within the above range, the woven fabric can have a necessary tear strength while being lightweight and thin. On the other hand, if the tear strength of the woven fabric is less than 8 N, depending on the intended use, the woven fabric may be low in tear strength. If the tear strength of the woven fabric exceeds 50 N, the fineness of the synthetic multifilament needs to be increased so that a resulting fabric undesirably tends to be thick and hard.

The initial air permeability of the woven fabric before washing according to Frazier type method is preferably 1.5 cc/cm$^2$/s or less, more preferably 1.0 cc/cm$^2$/s or less. When the air permeability before washing is 1.5 cc/cm$^2$/s or less, the woven fabric has excellent down-proofness.

The air permeability of the woven fabric after 10-times washing is preferably 2.0 cc/cm$^2$/s or less, more preferably 1.5 cc/cm$^2$/s or less. When the air permeability after 10-times washing is 2.0 cc/cm$^2$/s or less, leakage of down through the woven fabric during washing does not occur and therefore it can be said that the woven fabric has excellent washing durability. On the other hand, if the air permeability after 10-times washing exceeds 2.0 cc/cm$^2$/s, leakage of down occurs, which significantly degrades the quality of down jackets etc.

The initial water-pressure resistance of the woven fabric before washing is preferably 300 mm or higher, more preferably 350 mm or higher. When the initial water-pressure resistance is 300 mm or higher, it can be said that the woven fabric has excellent down-proofness and therefore has the effect of resisting penetration of rainwater during rainfall. On the other hand, if the initial water-pressure resistance is less than 300 mm, rainwater penetrates down during rainfall and therefore the effects of down such as heat-retaining property etc., tend to be reduced.

The retention ratio of water-pressure resistance of the woven fabric after 20-times washing with respect to the initial water-pressure resistance is preferably 70% or higher, more preferably 75% or higher. When the retention ratio of water-pressure resistance of the woven fabric after 20-times washing with respect to the initial water-pressure resistance is 70% or higher, deterioration of down-proofness (leakage of down) caused by washing can be prevented and minimum water-proofness required for the woven fabric can be easily ensured.

The METSUKE (mass per unit area) of the woven fabric is preferably 20 g/m$^2$ or more, more preferably 25 g/m$^2$ or more, but is preferably 60 g/m$^2$ or less, more preferably 55 g/m$^2$ or less. By setting the METSUKE of a resulting woven fabric to a value within the above range, it is possible to obtain a woven fabric that is lightweight and thin and has low air permeability. On the other hand, if the METSUKE of the woven fabric is less than 20 g/m$^2$, the woven fabric is lightweight and thin, but cannot have low air permeability. If the METSUKE of the woven fabric exceeds 60 g/m$^2$, the woven fabric has low air permeability, but is thick and is therefore not lightweight.

Hereinbelow, the present invention will be described with reference to the accompanying drawings, but the present invention is not limited to an embodiment shown in the drawings.

Figure 2:
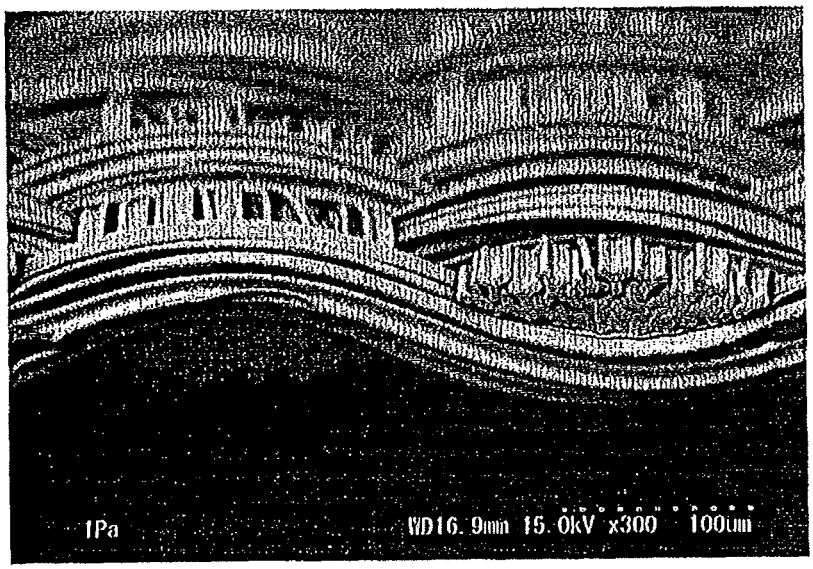
FIG. 2 is a SEM photograph of the cross section of an embodiment of a woven fabric according to the present invention before calendering.
Figure 3:
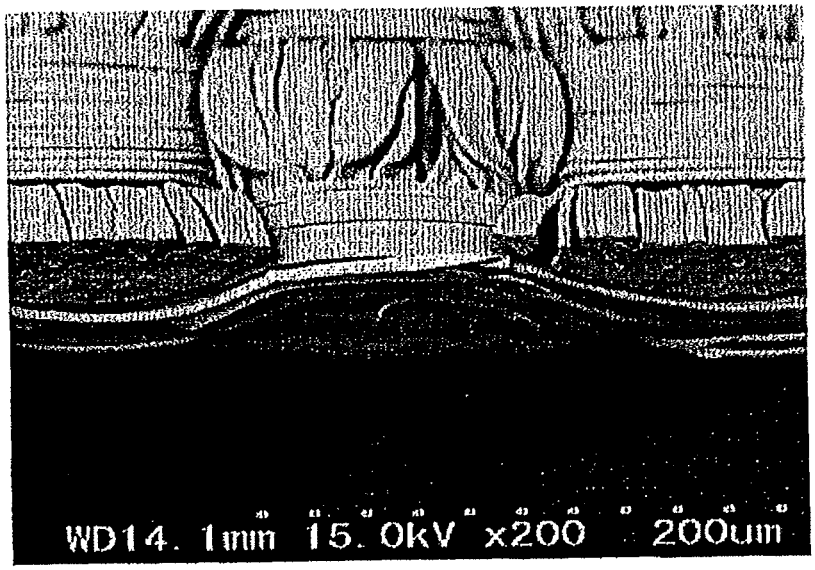
FIG. 3 is a SEM photograph of the cross section of the embodiment of the woven fabric according to the present invention after calendering.

FIG. 2 is a SEM photograph of the cross section of an embodiment of the woven fabric according to the present invention before calendering. In the woven fabric before calendering, projections and recesses of the adjacent monofilaments overlap each other in each of the synthetic multifilaments. FIG. 3 is a SEM photograph of the cross section of the embodiment of the woven fabric according to the present invention after calendering. In the woven fabric after calendering, the monofilaments are compressed and fixed in a state where they overlap one another in at least part of the synthetic multifilaments.

The woven fabric according to the present invention is lightweight and thin, has a high tear strength, and can retain low air permeability even after washing, and is therefore suitable for use as a covering fabric for, for example, down wear, down jackets, futons, and sleeping bags.

EXAMPLES

Hereinbelow, the present invention will be more specifically described using examples and comparative examples, but is not limited thereto. Various changes and modifications may be made without departing from the concepts described above and below, and all of them are included in the technical scope of the present invention. Measurement methods used in the present invention are as follows.

(Degree of Modification)

The length of the major axis (the longest diameter) and the length of the minor axis (the shortest diameter) of the cross section of a monofilament were measured at 1500 magnifications using a VH-Z450 microscope and a VH-6300 measuring instrument (manufactured by KEYENCE CORPORATION), and the ratio of the length of the major axis (the longest diameter) to the length of the minor axis (the shortest diameter) of the cross section of the monofilament was calculated. The average of the ratios of three monofilaments was defined as the degree of modification.

(Fineness)

Three skeins of a multifilament of 100 m length were prepared. The mass (g) of each of the skeins was measured to determine an average. The fineness (total fineness) of the multifilament was determined by multiplying the average by 100. The fineness of a monofilament was determined by dividing the fineness of the multifilament by the number of filaments.

(Limiting Viscosity)

The limiting viscosity [η] of a mixed solvent of p-chlorophenol and tetrachloroethane (p-chlorophenol/tetrachloroethane=75/25) was measured at 30° C., and was converted into the limiting viscosity (IV) of a mixed solvent of phenol and tetrachloroethane (phenol/tetrachloroethane=60/40) using the following formula:

$$IV=0.8325\times[\eta]+0.005.$$

(Relative Viscosity)

A sample was dissolved in a 96.3±0.1% by mass concentrated sulfuric acid (special grade reagent) to achieve a polymer concentration of 10 mg/ml to prepare a sample solution. An Ostwald viscometer with a flow time for water of 6 to 7 seconds at a temperature of 20° C.±0.05° C. was used to measure flow time $T_1$ (sec) for 20 mL of the prepared sample solution and flow time $T_0$ (sec) for 20 mL of 96.3±0.1% by mass concentrated sulfuric acid (special grade reagent) used to dissolve the sample at a temperature of 20° C.±0.05° C. The relative viscosity (RV) of a material used was calculated by the following formula:

$$RV=T_1/T_0.$$

(Breaking Strength)

A model 4301 universal testing machine (manufactured by Instron Japan Co., Ltd.) was used. A load (g) of 1/33 of fineness (dtex) was applied to a sample having a length of 20 cm at a tensile rate of 20 cm/min to measure the force required to break the sample. Measurement was performed three times, and an average of measurements was defined as breaking strength.

(Breaking Elongation)

Measurement was performed in the same manner as the measurement of breaking strength. An average of measurements of elongation at break was defined as breaking elongation.

(Compression State of Monofilaments)

The compression state of monofilaments was evaluated by observing the degree of overlap among monofilaments constituting a multifilament constituting a woven fabric by using a VH-Z450 microscope (manufactured by KEYENCE CORPORATION.). The evaluation was performed according to the following criteria.

good: Degree of overlap among monofilaments is high.

poor: Degree of overlap among monofilaments is not high.

(METSUKE: Mass Per Unit Area)

The METSUKE of a woven fabric was determined by measuring a mass per unit area specified in JIS L 1096 8. 4.

(Cover Factor)

The cover factor (CF) of a woven fabric was calculated by the following formula:

$$CF=T\times(DT)^{1/2}+W\times(DW)^{1/2},$$

wherein T represents the warp density of the woven fabric (the number of yarns/2.54 cm), W represents the weft density of the woven fabric (the number of yarns/2.54 cm), DT represents the fineness (dtex) of the warp constituting the woven fabric, and DW represents the fineness (dtex) of the weft constituting the woven fabric.

(Tear Strength)

The tear strength of a woven fabric was measured in both the warp and weft directions according to a tear strength test method D (pendulum method) specified in JIS L 1096 8. 15. 5.

(Air Permeability)

The air permeability of a woven fabric was measured according to an air permeability test method A (Frazier type method) specified in JIS L 1096 8. 27. 1.

(Water-Pressure Resistance)

The water-pressure resistance of a woven fabric was measured according to a water-pressure resistance test method A (low water-pressure method) specified in JIS L 1092.

(Washing Durability)

A woven fabric was washed according to F-2 method described in JIS L 1096 8. 64. 4 (dimensional changes of woven fabric). In the case of 10-times washing, a cycle of washing, spin-drying, and drying was repeated ten times, and in the case of 20-times washing, the cycle was repeated twenty times. Drying was performed by line drying. The water-pressure resistance of the woven fabric after 20-times washing was measured by the above-described method, and the retention ratio of water-pressure resistance of the woven fabric after 20-times washing with respect to the initial water-pressure resistance was calculated. The washing durability of the woven fabric was evaluated based on the air permeability after 10-times washing and the retention ratio of water-pressure resistance after 20-times washing.

(Feeling)

The feeling of a woven fabric was rated by randomly-selected five testers using a plain weave fabric 56T24F as a blank on a scale of 1 to 5, with 1 being the hardest and 5 being the softest.

Example 1

Nylon 6 polymer chips having a relative viscosity of 3.5 were melt-spun through a spinneret having 24 discharge openings (each having a structure shown in FIG. 1 in which the width "a" of a base of a slit was 0.07 mm, the width "b" of a tip of the slit was 0.11 mm, and the length "c" of the slit was 0.465 mm) at a spinning temperature of 288° C. Three first, second, and third godet rollers were used, and the speed of the first godet roller was set to 2000 m/min, the speed of the second godet roller was set to 3500 m/min, and the speed of the third godet roller was set to 3500 m/min. The polymer was drawn by the second godet roller at a drawing temperature of 153° C. As a result, a multifilament having a fineness of 33 dtex and constituted from 24 monofilaments having a degree of modification of 3.1 and a Y-shaped cross section was obtained. The breaking strength and breaking elongation of the thus obtained multifilament were evaluated by the above-described methods. Evaluation results are shown in Table 1.

A warp density was set to 186 yarns/2.54 cm and a weft density was set to 130 yarns/2.54 cm to weave a plain-weave fabric using the multifilament as the warp and weft.

According to conventional methods, the thus obtained fabric was scoured using an open soaper, preset using a pin tenter at 190° C. for 30 seconds, dyed in blue with an acid dye using a jet dyeing machine ("Circular NS" manufactured by Hisaka Works Co. Ltd.), and subjected to intermediate setting at 180° C. for 30 seconds. Then, one surface of the woven fabric was subjected to calendering (conditions: cylinder processing, temperature 150° C., pressure 2.45 MPa (25 kgf/cm$^2$), rate 20 m/min) twice, and then soft-finished to obtain a woven fabric having a warp density of 200 yarns/2.54 cm, a weft density of 135 yarns/2.54 cm, a cover factor of 1923, and a METSUKE of 49 g/m$^2$. The compression state of the monofilaments constituting the multifilament, feeling, tear strength, initial air permeability, water-pressure resistance, and washing durability of the obtained woven fabric were evaluated by the above-described methods. Evaluation results are shown in Table 1.

Example 2

Figure 4:
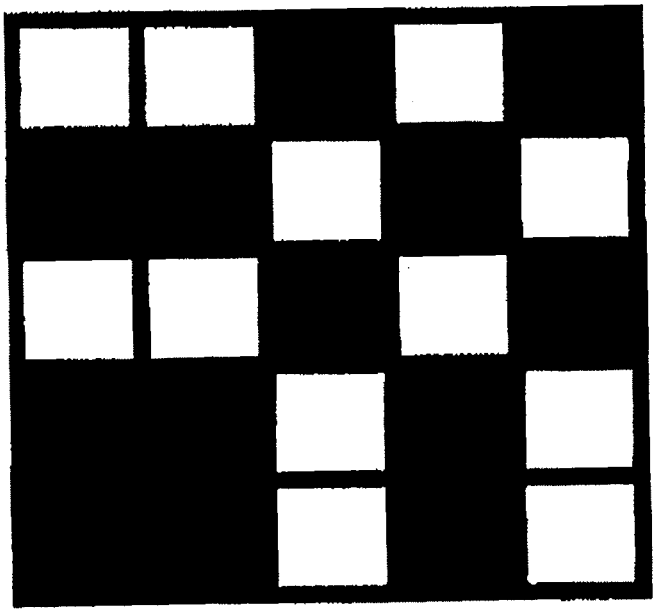
FIG. 4 is a schematic diagram illustrating a weave structure used for the woven fabric according to the present invention.

A multifilament and a woven fabric were produced in the same manner as in Example 1 except that the multifilaments were woven into a fabric with a mini-rip weave (rip-stop taffeta weave) shown in FIG. 4. The obtained multifilament and woven fabric were evaluated in the same manner as in Example 1. Evaluation results are shown in Table 1.

Example 3

A multifilament and a woven fabric were produced in the same manner as in Example 1 except that, after intermediate setting, the back surface of the woven fabric was subjected to calendering twice and the front surface of the woven fabric was subjected to calendering once. The obtained multifilament and woven fabric were evaluated in the same manner as in Example 1. Evaluation results are shown in Table 1.

Example 4

A multifilament and a woven fabric were produced in the same manner as in Example 1 except that the spinneret having Y-shaped discharge openings was changed to a spinneret having cross-shaped discharge openings. The obtained multifilament and woven fabric were evaluated in the same manner as in Example 1. Evaluation results are shown in Table 1.

Comparative Example 1

A multifilament and a woven fabric were produced in the same manner as in Example 1 except that the spinneret having Y-shaped discharge openings was changed to a spinneret having circular discharge openings with a diameter of 0.25 mm. The obtained multifilament and woven fabric were evaluated in the same manner as in Example 1. Evaluation results are shown in Table 1.

Comparative Example 2

A multifilament having a fineness of 56 dtex and constituted from 24 monofilaments having a degree of modification of 3.0 was produced in the same manner as in Example 1 except that the amount of the polymer discharged from an extruder was changed so that the fineness of a resulting multifilament became 56 dtex. A woven fabric was produced in the same manner as in Example 1 except that the multifilament of Comparative Example 2 was used. The obtained multifilament and woven fabric were evaluated in the same manner as in Example 1. Evaluation results are shown in Table 1.

Comparative Example 3

A multifilament having a fineness of 5.5 dtex and constituted from 5 monofilaments having a degree of modification of 1.5 was produced in the same manner as in Example 1 except that the spinneret having 24 Y-shaped discharge openings was changed to a spinneret having 5 triangular discharge openings and that the amount of the polymer discharged from an extruder was changed so that the fineness of a resulting multifilament became 5.5 dtex. A woven fabric was produced in the same manner as in Example 1 except that the multifilament of the above-mentioned multifilament was used as the warp and weft, a warp density was set to 280 yarns/2.54 cm and a weft density was set to 275 yarns/2.54 cm, and the multifilaments were woven into a fabric with a rip weave. The obtained multifilament and woven fabric were evaluated in the same manner as in Example 1. Evaluation results are shown in Table 1.

Comparative Example 4

A multifilament and a woven fabric were produced in the same manner as in Example 1 except that the density of the multifilaments used as the warp for weaving was set to 95 yarns/2.54 cm and the density of the multifilaments used as the weft for weaving was set to 98 yarns/2.54 cm. The obtained multifilament and woven fabric were evaluated in the same manner as in Example 1. Evaluation results are shown in Table 1.

Comparative Example 5

A multifilament and a woven fabric were produced in the same manner as in Example 1 except that the spinneret having Y-shaped discharge openings was changed into a spinneret having cross-shaped discharge openings. The obtained multifilament and woven fabric were evaluated in the same manner as in Example 1. Evaluation results are shown in Table 1.

Comparative Example 6

A multifilament and a woven fabric were produced in the same manner as in Example 1 except that the woven fabric was not subjected to calendering. The obtained multifilament and woven fabric were evaluated in the same manner as in Example 1. Evaluation results are shown in Table 1.

TABLE 1

| | | Example 1 | Example 2 | Example 3 | Example 4 | Comparative Example 1 | Comparative Example 2 | Comparative Example 3 | Comparative Example 4 | Comparative Example 5 | Comparative Example 6 |
|---|---|---|---|---|---|---|---|---|---|---|---|
| Monofilament | Shape of cross section | Y | Y | Y | cross | circle | Y | triangle | Y | cross | Y |
| | Degree of modification | 3.1 | 3.1 | 3.1 | 3.5 | 1.0 | 3.0 | 1.5 | 3.1 | 6.5 | 3.1 |
| | Fineness (dtex) | 1.375 | 1.375 | 1.375 | 1.375 | 1.375 | 2.33 | 1.1 | 1.375 | 1.375 | 1.375 |
| Multifilament | Number of monofilament | 24 | 24 | 24 | 24 | 24 | 24 | 5 | 24 | 24 | 24 |
| | Fineness (dtex) | 33 | 33 | 33 | 33 | 33 | 56 | 5.5 | 33 | 33 | 33 |
| | Breaking strength (cN/dt) | 4.4 | 4.4 | 4.4 | 4.2 | 5.0 | 4.5 | 3.8 | 4.4 | 4.0 | 4.4 |
| | Breaking elongation (%) | 43 | 43 | 43 | 40 | 43 | 43 | 35 | 43 | 37 | 43 |
| Woven fabric | Weave | plain | rip | plain | plain | plain | plain | rip | plain | plain | plain |
| | Calendering | one side | one side | both sides | one side | one side | one side | one side | one side | one side | none |
| | Compression state of monofilaments | good | good | good | good | poor | good | poor | good | good | poor |
| | Thickness (mm) | 0.06 | 0.07 | 0.06 | 0.07 | 0.07 | 0.11 | 0.03 | 0.07 | 0.07 | 0.07 |
| | METSUKE (g/m$^2$) | 49 | 53 | 49 | 49 | 48.8 | 78 | 20 | 42 | 48.5 | 50 |
| | Finishing density (the number of yarns/2.54 cm) Weft | 200 | 248 | 200 | 200 | 200 | 182 | 800 | 110 | 200 | 200 |
| | Warp | 135 | 147 | 135 | 135 | 135 | 107 | 290 | 110 | 135 | 135 |
| | Cover factor | 1923 | 2067 | 1923 | 1923 | 1923 | 2162 | 1383 | 1263 | 1923 | 1923 |
| | Tear strength (N) Weft | 24 | 22 | 9.1 | 9 | 25 | 25 | 5 | 24 | 7.2 | 30 |
| | Warp | 12 | 13 | 8.2 | 8.5 | 12 | 14 | 3 | 12 | 5.4 | 22 |
| | Feeling | 5 | 4 | 2 | 3 | 4 | 3 | 5 | 5 | 3 | 5 |
| | Initial air permeability (cc/cm$^2$/s) | 0.6 | 0.6 | 0.6 | 0.5 | 0.6 | 1.2 | 1.0 | 2.4 | 0.6 | 5.0 |
| | Initial water-pressure resistance (mm) | 400 | 450 | 460 | 440 | 400 | 410 | 390 | 250 | 400 | 80 |
| | Air permeability after 10 times washing (cc/cm$^2$/s) | 1.1 | 1.1 | 1.1 | 1.2 | 2.1 | 3.0 | 2.2 | 5.0 | 1.2 | 7.0 |
| | Water-pressure resistance after 20 times washing | 320 | 355 | 391 | 330 | 260 | 262 | 240 | 90 | 320 | 20 |
| | Retention ratio of water-pressure resistance after 20 times washing (%) | 80 | 79 | 85 | 75 | 65 | 64 | 62 | 36 | 80 | 25 |

The woven fabrics of Examples 1 to 4 were lightweight and thin, had a high tear strength, and retained low air permeability even after washing.

On the other hand, in the case of the woven fabric of Comparative Example 1 using monofilaments having a circular cross section, the degree of overlap among the monofilaments was not high even after calendering, that is, the compression state of the monofilaments was not good. Therefore, the woven fabric of Comparative Example 1 was poor in washing durability evaluated by air permeability and water-pressure resistance. The woven fabric of Comparative Example 2 using a multifilament having a large fineness was bulky, heavy, and hard and poor in washing durability. The woven fabric of Comparative Example 3 using a multifilament having a small fineness and constituted from monofilaments having a low degree of modification and a triangular cross section was lightweight and soft, but had a low tear strength and was poor in washing durability because the degree of overlap among the monofilaments constituting the multifilament was not high. The woven fabric of Comparative Example 4 had a low cover factor and was therefore lightweight, but had high air permeability even before washing. The woven fabric of Comparative Example 5 using monofilaments having a high degree of modification had a low tear strength. The woven fabric of Comparative Example 6 not subjected to calendering had high air permeability even before washing and was very poor in washing durability.

INDUSTRIAL APPLICABILITY

The woven fabric according to the present invention is suitable for use as a covering fabric for, for example, down wear, down jackets, futons, and sleeping bags.

DESCRIPTION OF REFERENCE NUMERALS

1 slit
3 base
5 tip
10 spinneret discharge opening

The invention claimed is:

1. A woven fabric for a down wear or a down jacket, said woven fabric comprising synthetic multifilaments made of monofilaments having projections and recesses, the woven fabric having at least one surface calendered so that, in at least part of the synthetic multifilaments, the monofilaments making up the synthetic multifilaments are compressed and fixed in a state where the projections and recesses of adjacent monofilaments overlap one another in such a manner that the monofilaments are tightly bound together, wherein:

the monofilaments are modified cross-section yarns having a degree of modification before calendaring of 2.0 to 6.0 and a Y-shaped or cross-shaped cross section, the synthetic multifilaments have a fineness of 7 dtex to 44 dtex, the breaking elongation of the synthetic multifilaments is 35% to 50%, the woven fabric has a cover factor of 1300 to 2200, each of the projections of the Y-shaped cross section or the cross-shaped cross section has a structure in which a width of its tip is larger than that of its base, such that each projection comprises (i) a segment having a width which is larger than that of its base and (ii) a remaining segment, the segment of each projection having a width which is larger than that of the base is shorter than the remaining segment, the air permeability after 10-times washing of the woven fabric is 1.50 $cc/cm^2/s$ or less, the initial water-pressure resistance of the woven fabric before washing is 300 mm or higher, and the retention ratio of water-pressure resistance after 20-times washing of the woven fabric with respect to initial water-pressure resistance is 70% or higher.

2. The woven fabric according to claim 1, wherein the monofilaments have a fineness of 0.4 dtex to 2.0 dtex.

3. The woven fabric according to claim 1, wherein the monofilaments are made of a polyamide or a polyester.

4. The woven fabric according to claim 1, wherein the tear strength of the woven fabric in both warp and weft directions as measured by a pendulum method is 8 N to 50 N.

* * * * *